US005996874A

United States Patent [19]

Fukushima et al.

[11] Patent Number: 5,996,874

[45] Date of Patent: Dec. 7, 1999

[54] CONTACT ARM LOCKING MECHANISM FOR SCREW DRIVING MACHINE

[75] Inventors: Yoshio Fukushima; Mitsugu Takezaki, both of Tokyo, Japan

[73] Assignee: Max Co., Ltd., Tokyo, Japan

[21] Appl. No.: 08/961,770

[22] Filed: Oct. 31, 1997

Related U.S. Application Data

[63] Continuation of application No. 08/601,764, Feb. 15, 1996, abandoned.

[30] Foreign Application Priority Data

Feb. 15, 1995 [JP] Japan ..... 7-050401
Nov. 20, 1995 [JP] Japan ..... 7-325104

[51] Int. Cl.[6] ..... B25B 21/00

[52] U.S. Cl. ..... 227/8; 227/130; 227/136; 227/138; 173/18; 173/104

[58] Field of Search ..... 227/8, 112, 119, 227/136, 142, 130, 138, 135; 173/6, 9, 11, 18, 104, 107, 106, 4, 5

[56] References Cited

U.S. PATENT DOCUMENTS

| | | | |
|---|---|---|---|
| 2,802,451 | 8/1957 | Chellis et al. | 173/18 |
| 2,826,176 | 3/1958 | Chellis et al. | 173/18 |
| 2,875,730 | 3/1959 | Carpenter et al. | 173/18 |
| 3,250,334 | 5/1966 | Sussman | 173/18 |
| 3,550,243 | 12/1970 | Allsop | 29/240 |
| 3,584,695 | 6/1971 | Turnbull | 173/107 |
| 3,708,097 | 1/1973 | Fisher | 227/136 |
| 3,773,239 | 11/1973 | Maynard | 227/130 |
| 3,971,421 | 7/1976 | Damratowski | 173/107 |
| 4,251,017 | 2/1981 | Doyle et al. | 227/8 |
| 4,294,391 | 10/1981 | Obergfell | 227/130 |
| 4,307,906 | 12/1981 | Schenk | 292/247 |
| 4,389,012 | 6/1983 | Grikis et al. | 227/120 |
| 4,405,071 | 9/1983 | Austin | 227/8 |
| 4,463,888 | 8/1984 | Geist et al. | 227/109 |
| 4,581,964 | 4/1986 | Takatsuru | 227/136 |
| 4,767,043 | 8/1988 | Canlas, Jr. | 227/8 |
| 4,821,937 | 4/1989 | Rafferty | 227/8 |
| 5,219,110 | 6/1993 | Mukoyama | 227/8 |
| 5,261,587 | 11/1993 | Robinson | 227/8 |
| 5,385,286 | 1/1995 | Johnson, Jr. | 227/8 |
| 5,564,614 | 10/1996 | Yang | 227/8 |
| 5,579,977 | 12/1996 | Yang | 227/8 |

FOREIGN PATENT DOCUMENTS

| | | |
|---|---|---|
| 6-36774 | 5/1994 | Japan . |
| 443 852 | 2/1968 | Switzerland . |
| 2 271 523 | 4/1994 | United Kingdom . |

*Primary Examiner*—Scott A. Smith
*Attorney, Agent, or Firm*—Morgan, Lewis & Bockius LLP

[57] ABSTRACT

A screw driving machine in which a screw having a head is screwed into a work, includes: a body; a nose section positioned toward the work with respect to the body, the nose section holding the screw to be driven; a hammering mechanism accommodated in the body, for hammering the screw into the work until the head of the screw held above the work; a screwing mechanism for screwing the screw hammered into the work; a contact arm slidable with respect to the nose section, the contact arm being pulled in toward the body when the contact arm is pushed against the work; and a locking mechanism for prohibiting the contact arm from sliding in its half way when the contact arm is pushed against the work, and for releasing the contact arm from locking after the hammering mechanism hammers the screw into the work.

6 Claims, 11 Drawing Sheets

CONTACT ARM LOCKING MECHANISM FOR SCREW DRIVING MACHINE

This application is a continuation of application Ser. No. 08/601,764, filed Feb. 15, 1996, now abandoned.

BACKGROUND OF THE INVENTION

1. Field of the Invention

This invention relates to a screw driving machine which hammers a screw and then screws it. More particularly, the invention relates to a contact arm locking mechanism in a screw driving machine in which a contact arm is locked by the locking mechanism on its half way.

2. Related Art

A screw driving machine, as disclosed by Japanese Utility Model Application Laid-Open No. Hei. 6-36774, has a driver which performs a screw hammering operation in a direction of axis, and a screwing operation around axis. The driver is driven by compressed air to hammer a screw into a material into which a screw is to be screwed (hereinafter referred to merely as "a work", when applicable), and screw the screw into the work. If, in the screw hammering operation, the stem of the screw penetrates the work, then the following screw screwing operation means nothing, and the screw has little extracting resistance from the work. Thus, in order to sufficiently hold the screw screwed in the work, it is essential to hammer the screw into the work to a predetermined depth according to the thickness of the work.

Hence, heretofore, as shown in FIGS. 6 through 8 of the Specification of the aforementioned Japanese Utility Model Application, in order to make the screw hammering stroke of the driver to end at a predetermined position, the following hammering depth control mechanism is employed: A contact member which abuts against the work is arranged slidably along a nose section from which screws are ejected. In hammering a screw into the work, the contact member is held at a predetermined stop position to hold the nose section at a predetermined distance (or at a predetermined height) from the surface of the work, thereby to adjust the screw hammering depth.

In the above-described hammering depth control mechanism, a rotary arm integral with the rotary shaft of a pinion-rack mechanism is engaged with the upper end of the contact member. When the trigger lever is operated, the screw hammering operation is started. Thereafter, the pinion-rack mechanism is operated. In association of the operation of the rack, the rotary arm is rotated to release the contact member, so that the screw screwing operation is carried out. The upper end of the contact member is moved to a retracting position located above beyond the position of the rotary arm. When the trigger lever is released after the screw screwing operation, the rack is reradiated, and the rotary arm is rotated to the initial position.

However, the rotary arm, while rotating to the initial position, may strike against the side surface of the contact member, thus obstructing the returning of the contact member. If the contact member is not returned to the initial position, in the next screw hammering operation, it is impossible to hammer the screw to the predetermined depth, and the pinion gear coaxial with the rotary arm cannot be returned to the initial position. Hence, in the next screw screwing operation, the screw is not sufficiently rotated, so that the screw is not sufficiently held in the work.

SUMMARY OF THE INVENTION

An object of the invention is to eliminate the above-described difficulties accompanying a conventional screw driving machine.

More particularly, an object of the invention is to provide a hammering depth control mechanism for a screw driving machine in which, even when the trigger lever is released with the contact member retracted along the nose section, the contact member can be returned to the initial position, and the pinion gear is also positively returned to the predetermined position.

A further object of this invention is to provide a bit disengagement preventing mechanism for a screw driving machine which prevents the bit from disengaging from the driving groove formed in the head of a screw after the screw has been hammered into a work piece to a predetermined depth.

According to a first aspect of the invention, there is provided a screw driving machine in which a screw having a head is screwed into a work, includes: a body; a nose section positioned toward the work with respect to the body, the nose section holding the screw to be driven; a hammering mechanism accommodated in the body, for hammering the screw into the work such that the head of the screw is held above the workpiece; a screwing mechanism for screwing the screw hammered into the work; a contact arm slidable with respect to the nose section, the contact arm being pulled in toward the body when the contact arm is pushed against the work; and a locking mechanism for prohibiting the contact arm from sliding in its half way when the contact arm is pushed against the work, and for releasing the contact arm from locking after the hammering mechanism hammers the screw into the work.

According to a second aspect of the invention, there is provided the screw driving machine of the first aspect wherein the locking mechanism includes: an upper edge formed on the contact arm; and a locking piece supported by the nose section, the locking piece being movable between a first position where the locking piece engages with the upper edge formed on the contact arm and a second position where the locking piece does not interfere with the sliding of the contact arm.

According to a third aspect of the invention, there is provided the screw driving machine of the second aspect, wherein the screwing mechanism includes an air motor, and the locking mechanism releases the contact arm from locking in accordance with hammering of the hammering mechanism before the air motor starts rotating.

According to a fourth aspect of the invention, there is provided the screw driving machine of the third aspect, wherein the screw driving machine further comprises an air cylinder device including: a cylinder; a feed piston slidably set in the cylinder; and a feed pawl pivotally connected to the feed piston, for feeding the screw to be hammered, the feed pawl pivotally supporting the locking piece of the locking mechanism.

According to a fifth aspect of the invention, there is provided the screw driving machine of the second aspect, wherein the screwing mechanism include a rack and a pinion gear engaging with the rack, the pinion connected with the locking piece such that the pinion moves the locking piece to the second position during screwing the screw.

The screw driving machine thus constructed functions as follows: In hammering a screw into the work, the end of the contact member is pushed against the surface of the work, so that the contact member is slid along the nose section. When, under this condition, the hammering mechanism is operated, the screw is hammered into the work. In this operation, the locking piece is at the first position. Therefore, while the contact member is retracted along the nose section, the locking piece is engaged with the engaging step, to regulate the amount of retraction. On the other hand, the end of the contact member is protruded from the end of the nose section. Hence, when the driver of the hammering mechanism is moved a predetermined distance, the screw hammering depth is decreased as much as the amount of protrusion of the contact member from the nose section. Thus, the screw hammering depth is controlled.

After the screw hammering operation, the pinion-rack mechanism is operated. That is, the pinion gear is rotated, and the locking piece is rotated in association with the rotation of the pinion gear. As a result, the locking piece is retracted from above the engaging step, and the contact member is retracted again. Thus, the screw can be screwed into the work. That is, the pinion-rack mechanism rotates the driver, thereby to screw the screw into the work.

After the screw screwing operation, the rack of the pinion-rack mechanism is returned to the initial position, while the pinion gear is also rotated to the initial position. If, in this case, the contact member has been returned to the initial protruded position, the locking piece rotated together with the pinion gear is also returned to the first position. In the case where the contract member is held retracted, the locking piece rotated together with the pinion gear strikes against the contact member. However, since the locking piece is rotatably supported on the drive shaft of the pinion gear, the drive shaft is turned to the initial position together with the pinion gear; however, the locking piece is held where it has struck against the contact member, and is rotated to the first position by the elastic force of the spring when the contact member is returned to the initial protruded position.

As is apparent from the above description, even if the trigger lever is released when the contact member is retracted along the nose member, the contact member can be returned to the initial position, and the pinion gear is also positively returned to the predetermined position. Hence, the screw driving machine of the invention is substantially free from the difficulties that the contact member returning operation is obstructed, so that when the next screw is not hammered to the predetermined depth, or it is not sufficiently screwed into the work, with the result that the screw is not sufficiently held in the work.

DETAILED DESCRIPTION OF THE PREFERRED EMBODIMENTS

Figure 1:
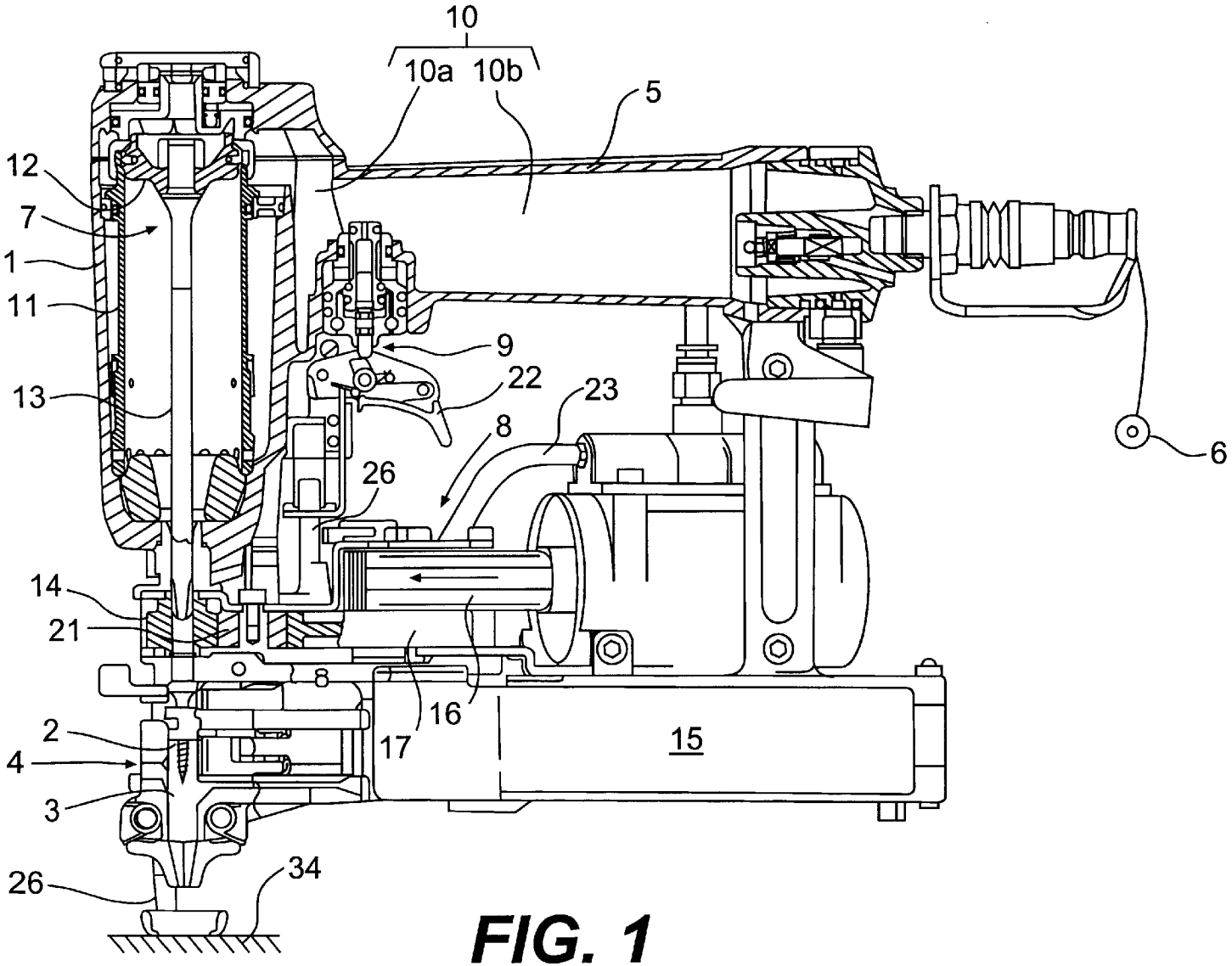
FIG. 1 is a vertical sectional view showing essential components of a screw driving machine according to the invention.

FIG. 1 shows a screw driving machine which constitutes an embodiment of the invention.

The screw driving machine, as shown in FIG. 1, comprises: a machine body 1; a nose section 4 having a screw ejecting outlet 3; and a grip section 5. The machine body 1 includes: a hammering mechanism 7 which hammers a screw 2 with compressed air which is supplied from an air supplying source; a pinion-rack mechanism 8 which screws the screw which has been hammered; and a trigger mechanism 9 which controls the operations of the above-described two mechanisms 7 and 8. The air supplying source 6 supplies compressed air to air storing chambers 10*a* and 10*b* which are formed in the grip section 5 and the machine body 1, respectively.

The hammering mechanism 7 is made up of a conventional piston-cylinder mechanism which is usually employed in an ordinary nailing machine. The compressed air from the air storing chamber in the machine body 1 is supplied to a hammering cylinder 11 to drive a driver 13 which is coupled to a hammering piston 12, while a screw 2 is fed to the screw ejecting outlet 3 of the nose section 4 through the screw feeding passageway of the magazine 15 by a screw feeding mechanism (not shown). The screw thus fed is hammered into the work to a certain depth.

Figure 2:
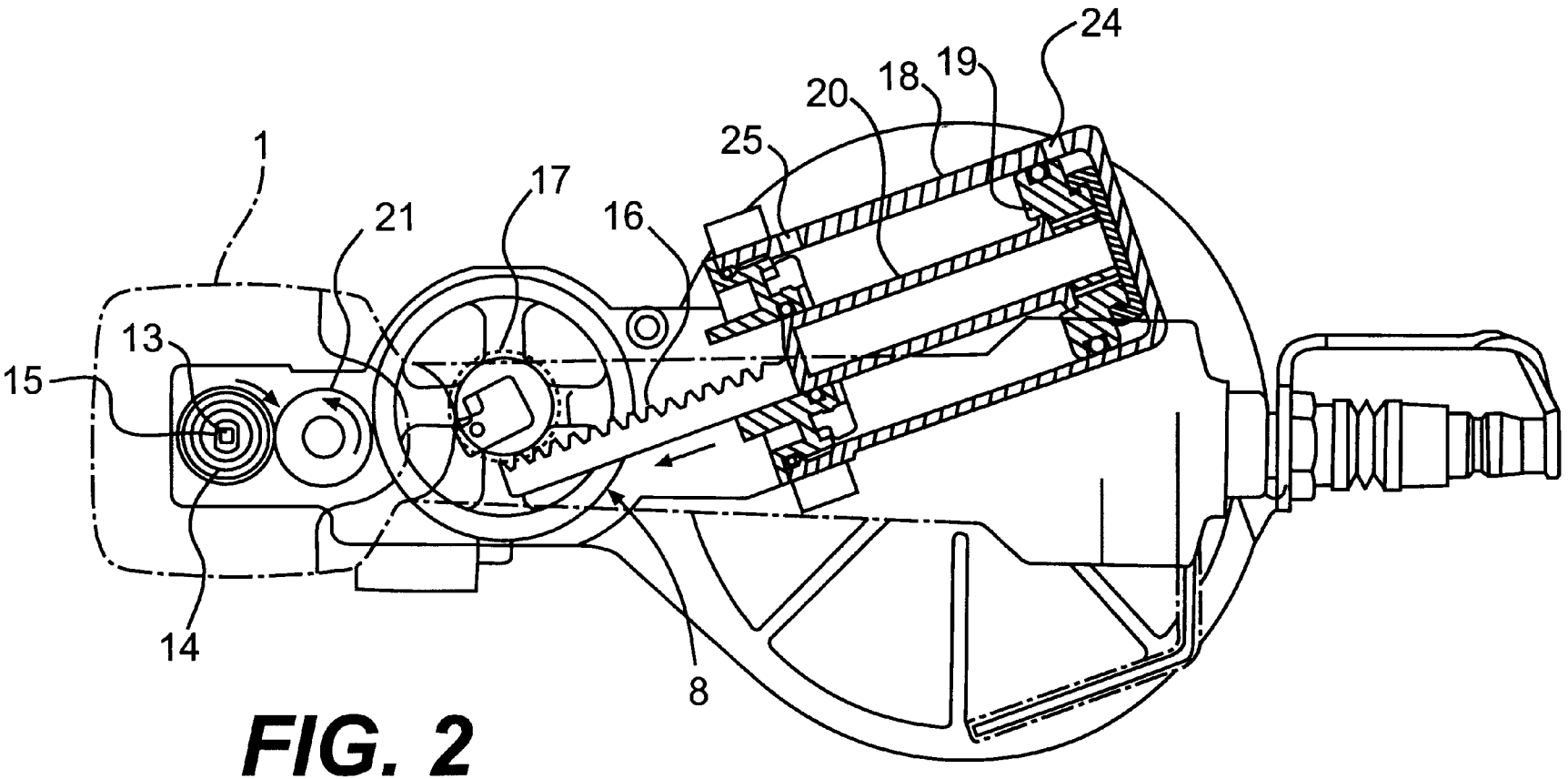
FIG. 2 is a sectional view showing a pinion-rack mechanism in the screw driving machine.

The driver 13 is provided with a driver guide 14. That is, the latter 14 slidably guides the driver 13 in the hammering direction, while rotating it. More specifically, as shown in FIG. 2, in the nose section 4, the driver guide 14 is rotatably supported around the axis of the driver 13, and it has a rectangular guide hole 15 at the center. The driver 13 is inserted into the guide hole 15. Hence, the driver 13 is able to axially slide independently of the driver guide 14; however, it is rotated following the rotation of the driver guide 14.

The pinion-rack mechanism 8 comprising a rack 16 and a pinion gear 17, is adapted to convert the linear motion of the rack 16 into the rotational motion of the pinion gear 17. The rack 16 is integral with the piston rod 20 of a piston 19 which is slidably accommodated inside the cylinder 18 of a piston-cylinder mechanism which is connected to the air storing chamber 10*a* in the grip section 5. The compressed air is introduced into the cylinder 18 alternately through air in/out holes 24 and 25, which are formed in the rear and front parts of the cylinder 18, so that the rack 16 is moved back and forth together with the piston 19. Accordingly, a pinion gear 17 engaged with the rack 16 is moved back and forth. The pinion gear 17 is engaged through an intermediate gear 21 to a gear formed along the outer periphery of the driver guide 14, so that the latter 14 is rotated as the pinion gear 17 rotates.

The trigger mechanism 9 is a valve mechanism in which a trigger lever 22 is manually operated to control the supply of driving air to the hammering mechanism 7. When the driving air is supplied to the upper surface of the hammering piston 12 of the hammering mechanism 7 to drive the piston 12, the air is compressed below the hammering piston 12 and supplied through a coupling pipe 23 to the pinion-rack mechanism 8, so that the air charge and discharge operations of the air in/out holes 24 and 25 are switched, thereby to operate the pinion-rack mechanism 8.

Figure 4:
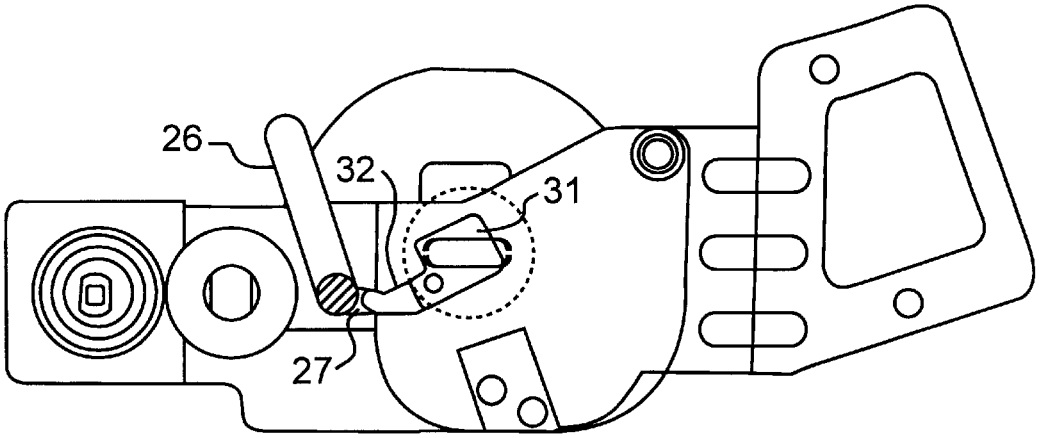
FIGS. 4(*a*) and 4(*b*) are a plan view and a central cross sectional diagram, respectively, showing the machine which is in initial operating state.
Figure 4:
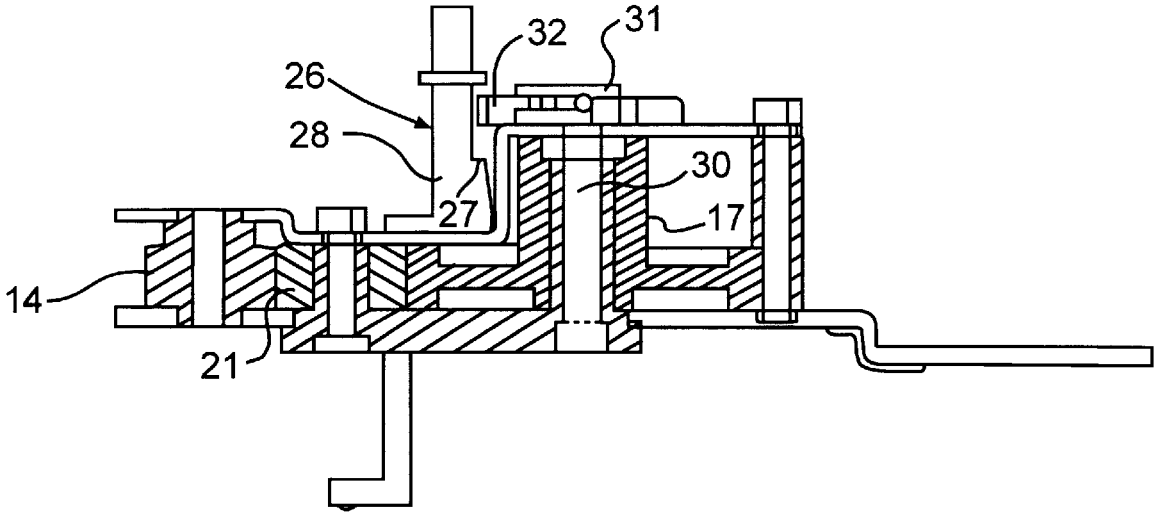
Figure 5:
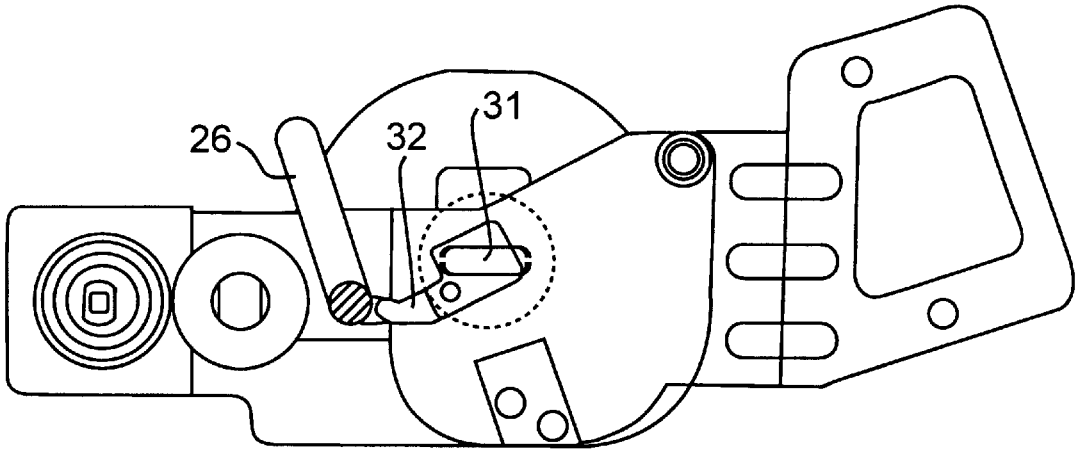
FIGS. 5(*a*) and 5(*b*) are a plan view and a central cross sectional diagram, respectively, showing an operating state of the machine which is hammering a screw in an work.
Figure 5:
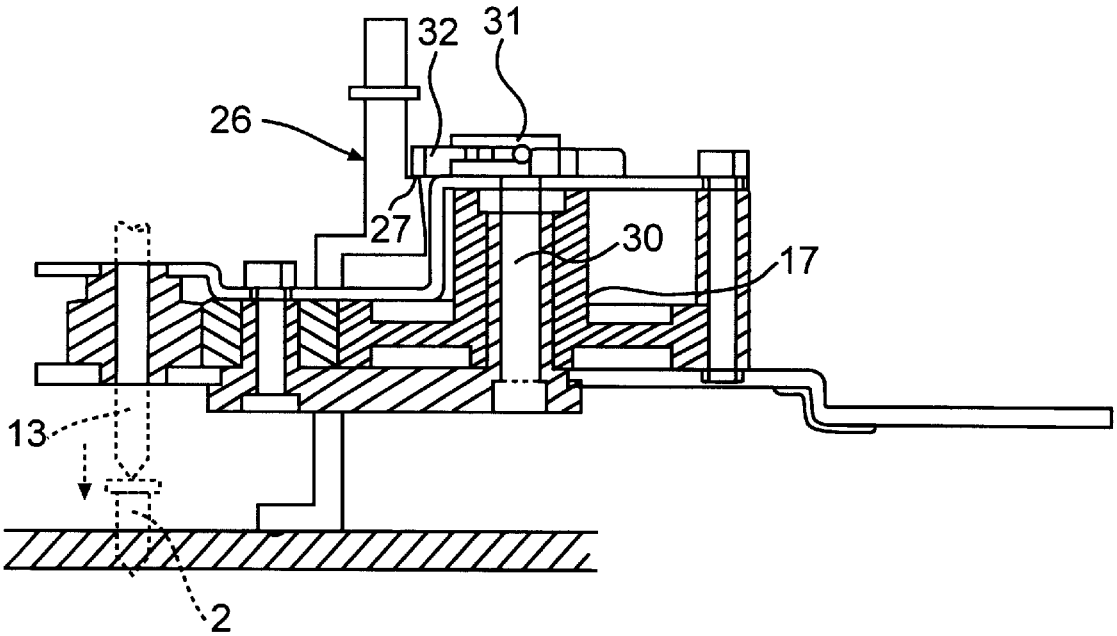

The trigger lever 22 is so designed that it is enabled under the condition that a contact member 26 detects a workpiece. As shown in FIG. 4(*b*), the contact member 26 is bent at the middle 28, and an engaging step 27 is formed at the middle 28 thus bent, and the upper end is confronted with the trigger lever 22. Its end portion is normally kept urged so as to protrude from the end of the nose section 4, and it is retracted along the nose section 4 as the contact member 26 is pushed against the surface of the work. On the basis of this retraction, the trigger lever 22 operates the trigger mechanism 9.

Figure 3:
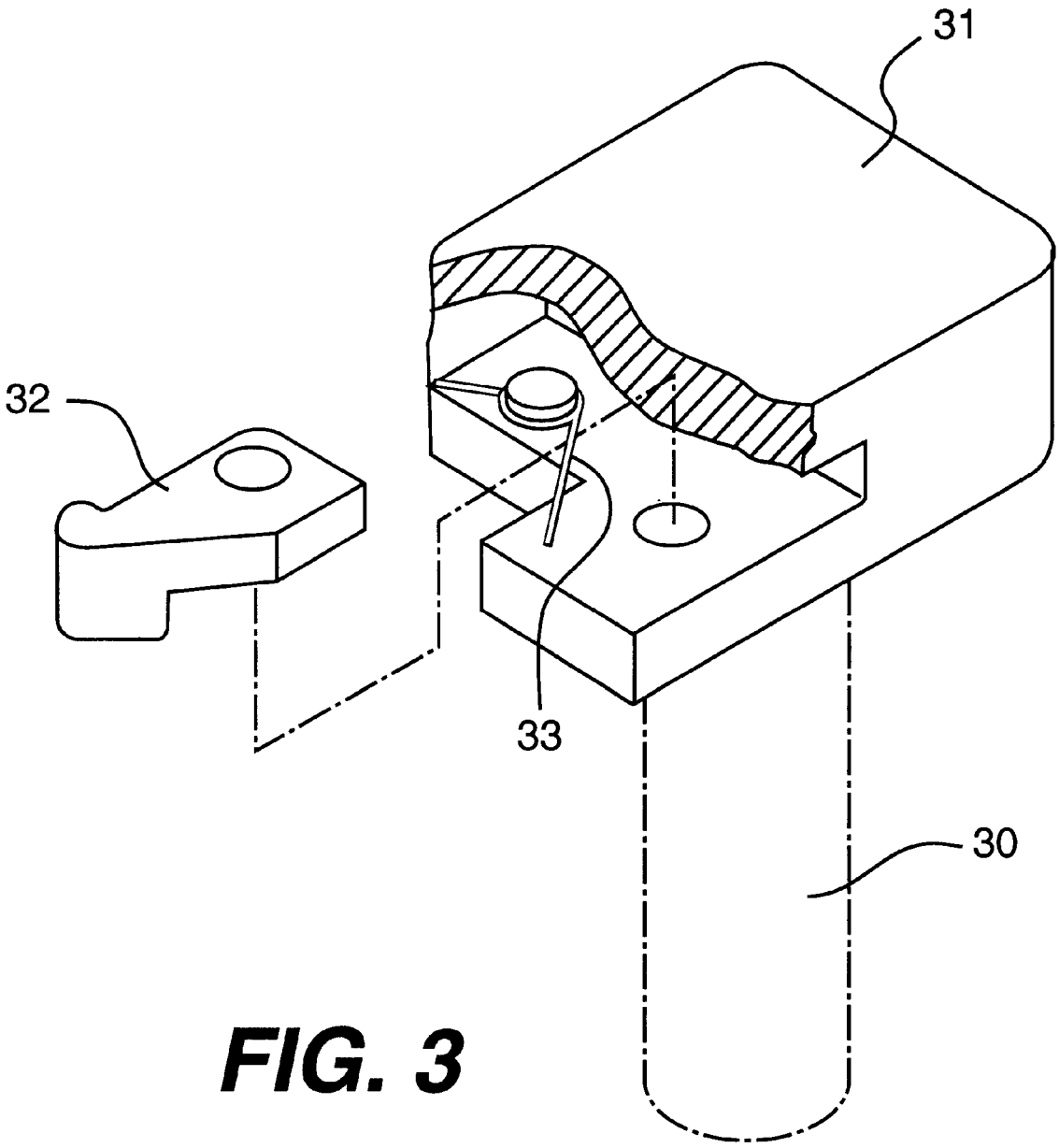
FIG. 3 is a perspective view of a rotary block.

As shown in FIG. 3, FIG. 4(*a*) and 4(*b*), a rotary block 31 is fixedly mounted on the top of a shaft 30 which is integral with the pinion gear 17 of the pinion-rack mechanism 8. The rotary block 31 thus mounted supports a stopper piece 32. The stopper piece 32 is so supported that it is turnable to a first position (shown in FIGS. 4(*a*), 4(*b*), 5(*a*) and 5(*b*)) where it is located above the engaging step 27, and to a second position (shown in FIGS. 6(*a*), 6(*b*), 7(*a*) and 7(*b*)) where it is retracted from the engaging step 27. The stopper piece 32 is urged by a spring 33 so that it is located at the first position before the pinion-rack mechanism 8 is operated.

When the stopper piece 32 is engaged with the engaging step 27 of the contact member 26, the contact member 26 is no longer retracted; that is, its retraction is stopped. However, even with this amount of motion, the trigger mechanism 9 can be operable, and at the stop position the end of the contact member 26 is protruded from the end of the nose section 4.

In addition, the machine is so designed that, during one stroke of the rack 16, the pinion is allowed to make less than one revolution (rotating 270° for instance) while the driver guide 14 makes about two revolutions.

In hammering the screw 2 with the screw driving machine thus constructed, first the end of the contact member 26 is pushed against the surface of the work 34. As a result, the contact member 26 is slid on the nose section 4. By pulling the trigger lever 22, the hammering mechanism 7 is operated, so that the hammering piston 12 and the driver 13 are driven, whereby the screw 2 fed to the screw ejecting outlet is hammered into the work 34. In this operation, the stopper piece 32 is located at the first position as shown in FIGS. 4(*a*) and 4(*b*). Hence, while the contact member 26 is retracted along the nose section 4, the stopper piece 32 is engaged with the engaging stage 27 so that the amount of retraction is limited. Since the end of the contact member 26 is protruded from the end of the nose section 4, when the driver 13 of the hammering mechanism 7 is moved as much as a predetermined distance, the screw hammering depth is decreased as much as the amount of protrusion of the contact member 26 from the nose section. Thus, the screw hammering depth can be adjusted.

Figure 6:
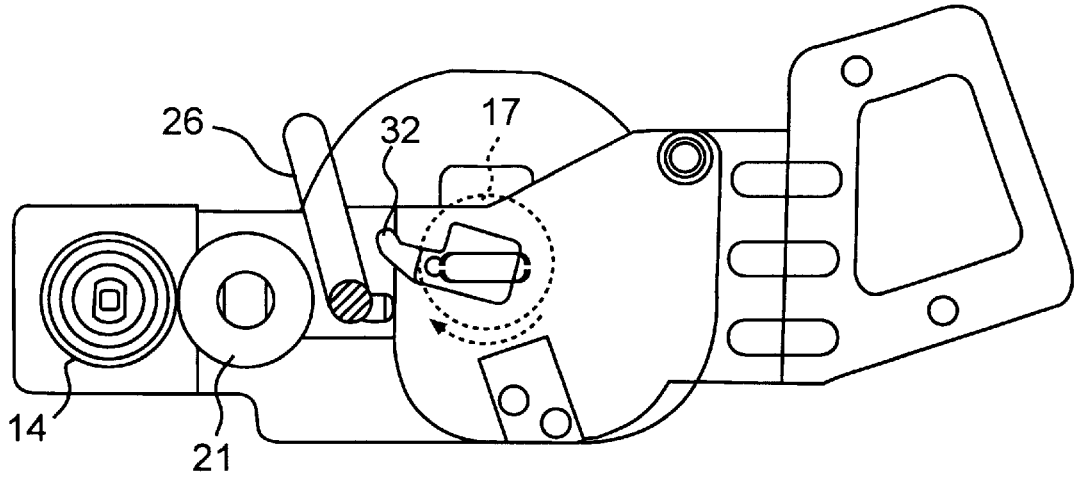
FIGS. 6(*a*) and 6(*b*) are a plan view and a central cross sectional diagram, respectively, showing another state of the machine which is screwing the screw in the work.
Figure 6:
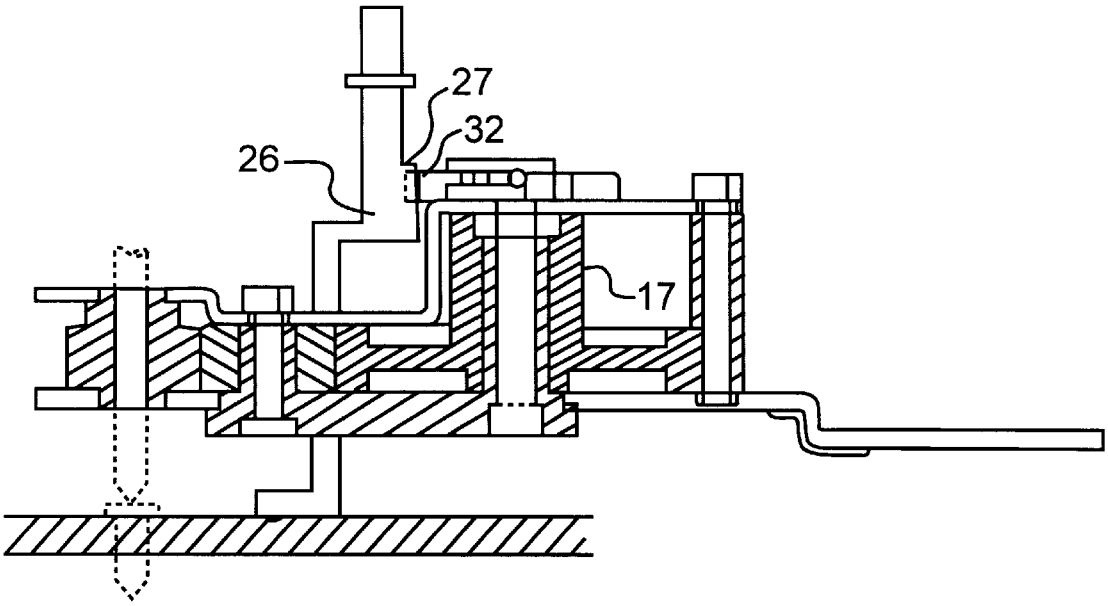

When, after the screw 2 has been hammered, the pinion-rack mechanism 8 is operated; that is, the rack 16 is moved forwardly while in association with the movement of the rack 16 the stopper piece 32 is rotated to the second position as shown in FIGS. 6(*a*) and 6(*b*); that is, the stopper piece 32 is retracted from the engaging stage 27, and the contact member 26 is retracted again. Thus, the screw 2 can be screwed in the material. As the pinion gear 17 rotates, the intermediate gear 21 and the driver guide 14 are rotated. In association with this operation, the driver 13 is rotated, so that the screw 2 is screwed into the work 34.

Figure 7:
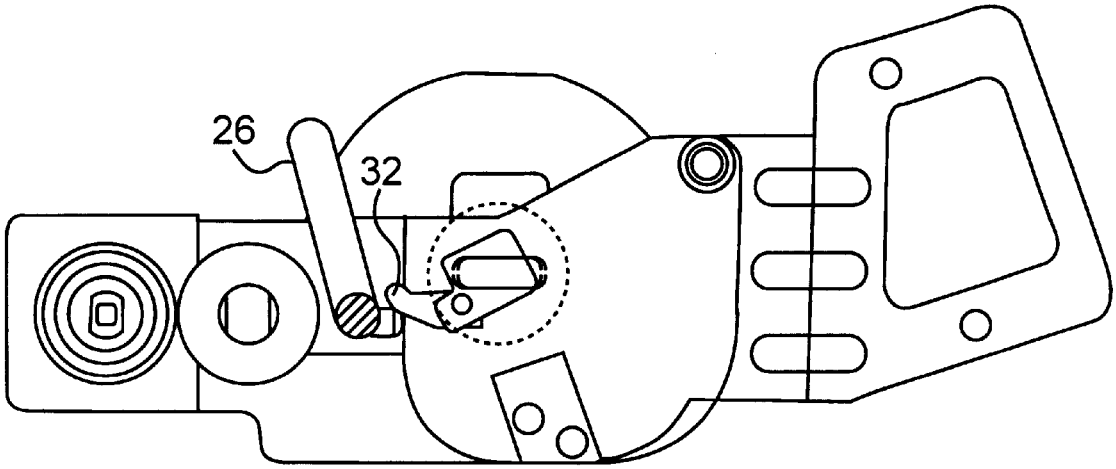
FIGS. 7(*a*) and 7(*b*) are a plan view and a central cross sectional diagram, respectively, showing another operating state of the machine in which, with the contact member retracted, the pinion-rack mechanism is returned.
Figure 7:
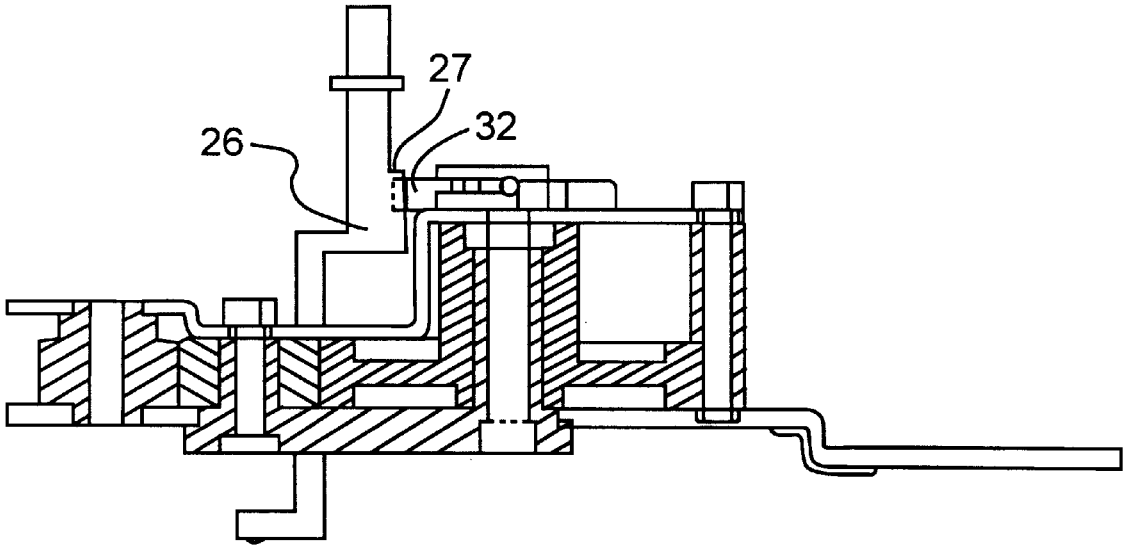

After the screw is screwed into the workpiece, the trigger lever 22 is released. As a result, the hammering piston 12 and the driver 13 are returned to the initial positions while the rack 16 of the pinion-rack mechanism 8 is returned to the initial position, and the pinion gear 17 is also returned to the initial position. If, in this case, the contact member 26 has been returned to its protruded position, then the stopper piece 32 rotated together with the pinion gear 17 is also moved to the first position. In the case where, on the other hand, the contact member 26 has been retracted, then the stopper piece 32 rotated together with the pinion strikes against the contact member 26 (cf. FIGS. 7(*a*) and 7(*b*)). However, the stopper piece 32 is rotatably supported by the drive shaft of the pinion gear 17. Hence, the drive shaft is rotated to the initial position together with the pinion gear 17, while the stopper piece 32 is held where it strikes against the contact member 26, and it is returned to the first position by the elastic force of the spring 33 when the contact member 26 returned to its initial protruded position.

Figure 8:
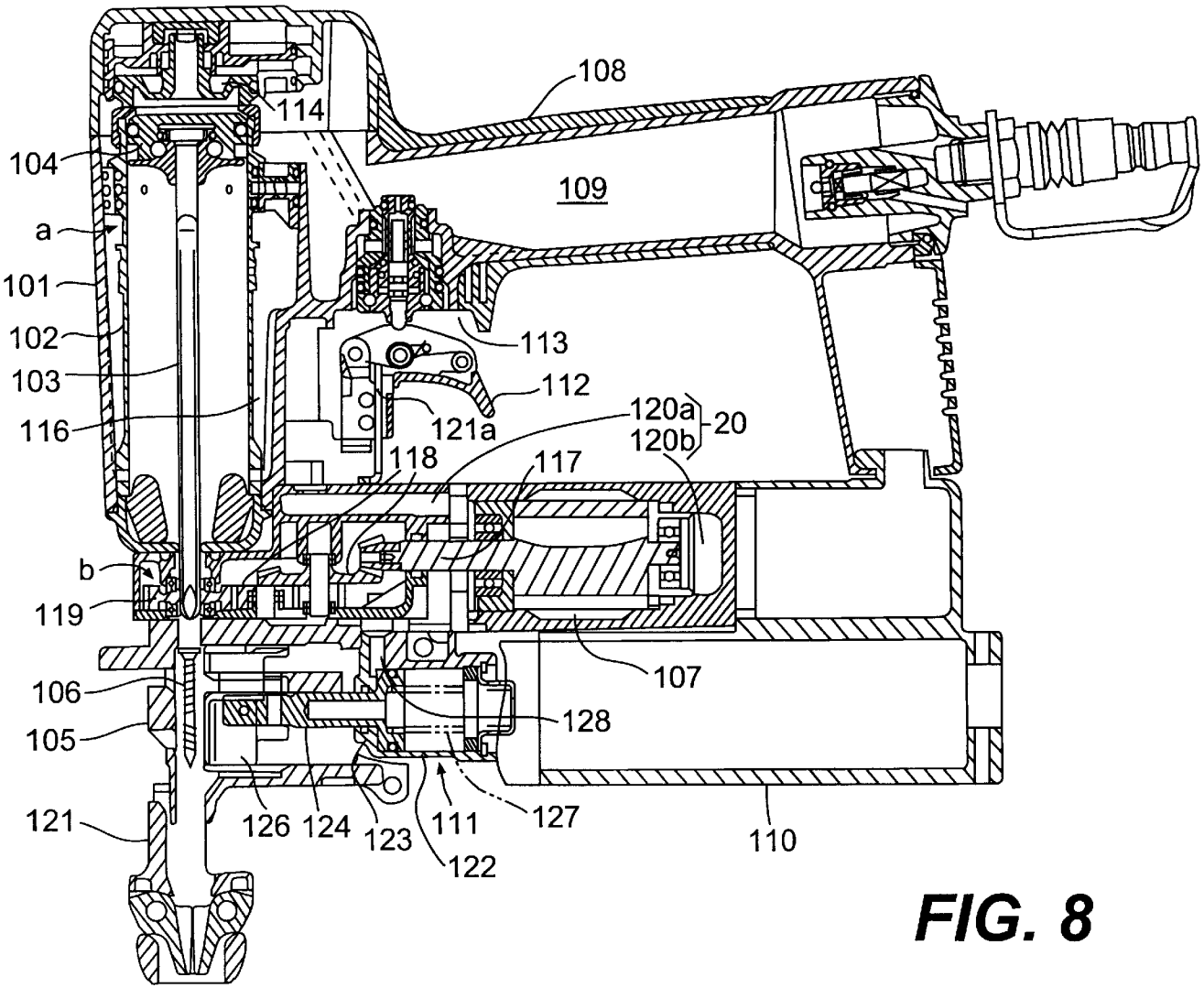
FIG. 8 is a vertical sectional diagram showing the arrangement of another screw driving machine according to the invention.

FIG. 8 shows another screw driving machine according to the invention. The machine comprises: a hammering mechanism a; and a screwing mechanism b. The hammering mechanism a is designed as follows: A hammering piston 104 with a screw driving bit 103 is vertically slidably provided inside a hammering cylinder 102 in a machine body 101. Compressed air is supplied into the hammering cylinder 102 to drive the hammering piston 104, thereby to cause the bit 103 to strike the screw 106 (supplied in a nose section 105 provided at the end of the machine body 101) until the screw is hammered into the work to a predetermined depth, with its head held above the work. The screwing mechanism b is designed as follows: An air motor 107 is driven by part of the compressed air supplied to the hammering cylinder 102, to screw the screw 106 into the work which has been hammered.

The compressed air is supplied to the hammering cylinder 102 from a compressed air supplying source through an air chamber 109 which is formed in a grip 108 and the machine body 101. Screws 106 to be driven are arranged one after another on a belt-shaped coupling material, and are accommodated in a magazine 110 with the belt-shaped coupling material coiled. The screws 106 are supplied to the nose section 105 one at a time by an air cylinder device 111 for supplying the screw.

Figure 9:
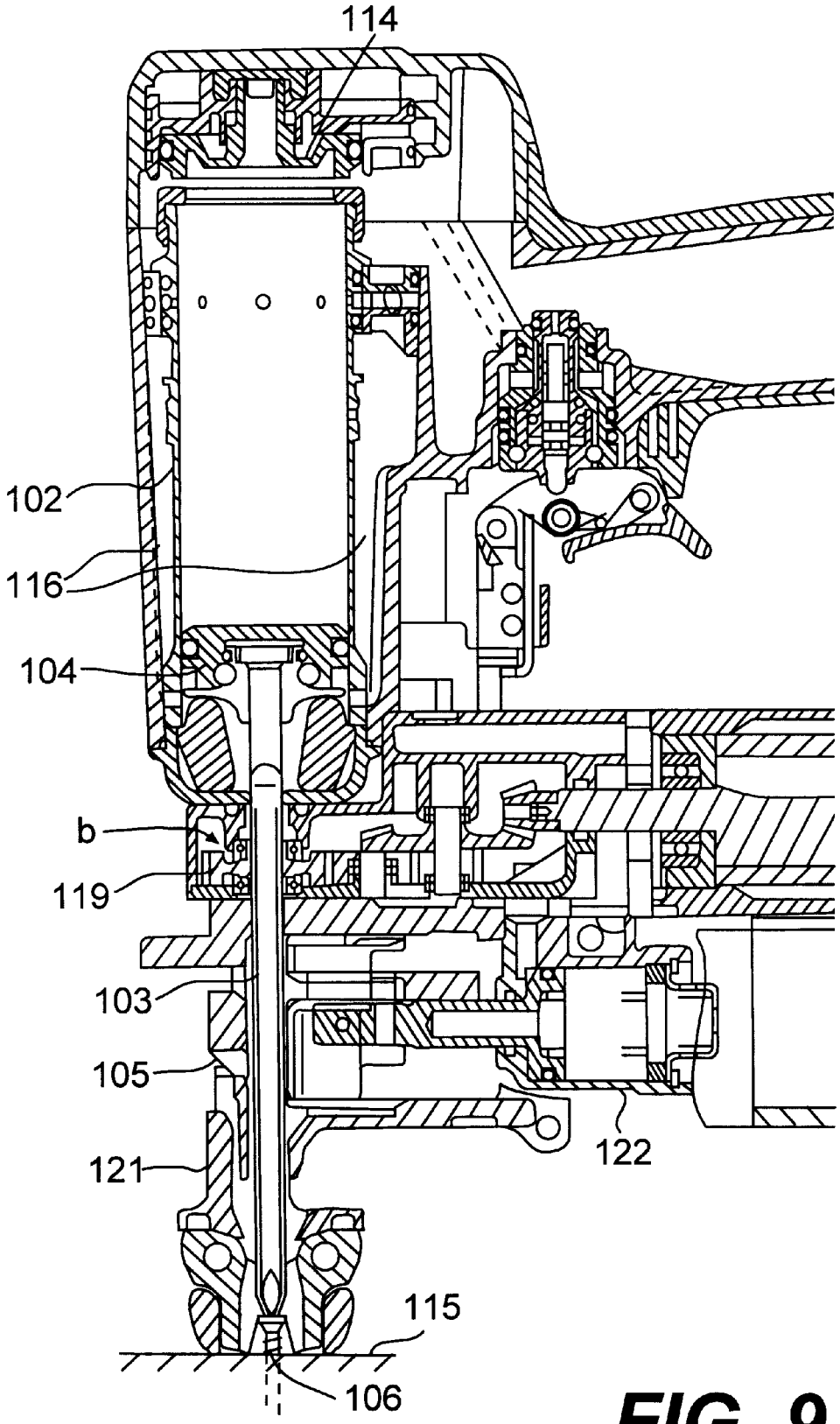
FIG. 9 is an explanatory diagram for a description of the hammering operation of the screw driving machine.

The hammering mechanism a is operated by operating a trigger lever 112. When the trigger lever 112 is operated, a trigger valve 113 is operated. In association with the operation of the trigger valve 113, a head valve 114 is opened as shown in FIG. 9, so that the compressed air is abruptly supplied from the air chamber 109 to the hammering cylinder 102 to drive the hammering piston 104. The screw 106, when hammered by the hammering mechanism a, is partially pushed into the work. The screw 106 thus pushed is screwed into the work with the screwing mechanism b.

When, on the other hand, the trigger lever 112 is released, the trigger valve 113 operates to cause the head valve 114 to close the hammering cylinder 102 from the air chamber 109, and opens it to an discharge opening. As a result, the pressure applied to the upper surface of the hammering piston 104 is decreased, while the pressure applied to the lower surface is increased by the compressed air which has been stored in a blow-back chamber 116 while being compressed by the hammering piston 104 during the hammering operation. That is, the pressure applied to the lower surface of the hammering piston 104 becomes higher than that applied to the upper surface, and therefore the latter 104 is returned to the uppermost point.

The screwing mechanism b is to transmit the rotation of the output shaft 117 of an air motor 107 through an intermediate gear 118 to a drive gear 119, thereby to rotate the bit 103 which is inserted into a non-circular through-hole formed in the drive gear 119 at the center. The air motor 107 is coupled through an air passageway 120 to the hammering cylinder 102, so that the former 107 is rotated by the compressed air supplied into the hammering cylinder 102. The air passageway 120 is communicated through the hammering cylinder 102 and through a passageway 120*a* with the air inlet section 120*b* of the air motor 107. Hence, after the operation of the hammering mechanism a, the screwing mechanism b is operated by the compressed air supplied through the air passageway 120, to screw the screw 106 into the work 115 which has been hammered. The bit 103 is so arranged that it is slidable along the axis of the drive gear 119 and is turnable together with the latter 119.

Figure 11:
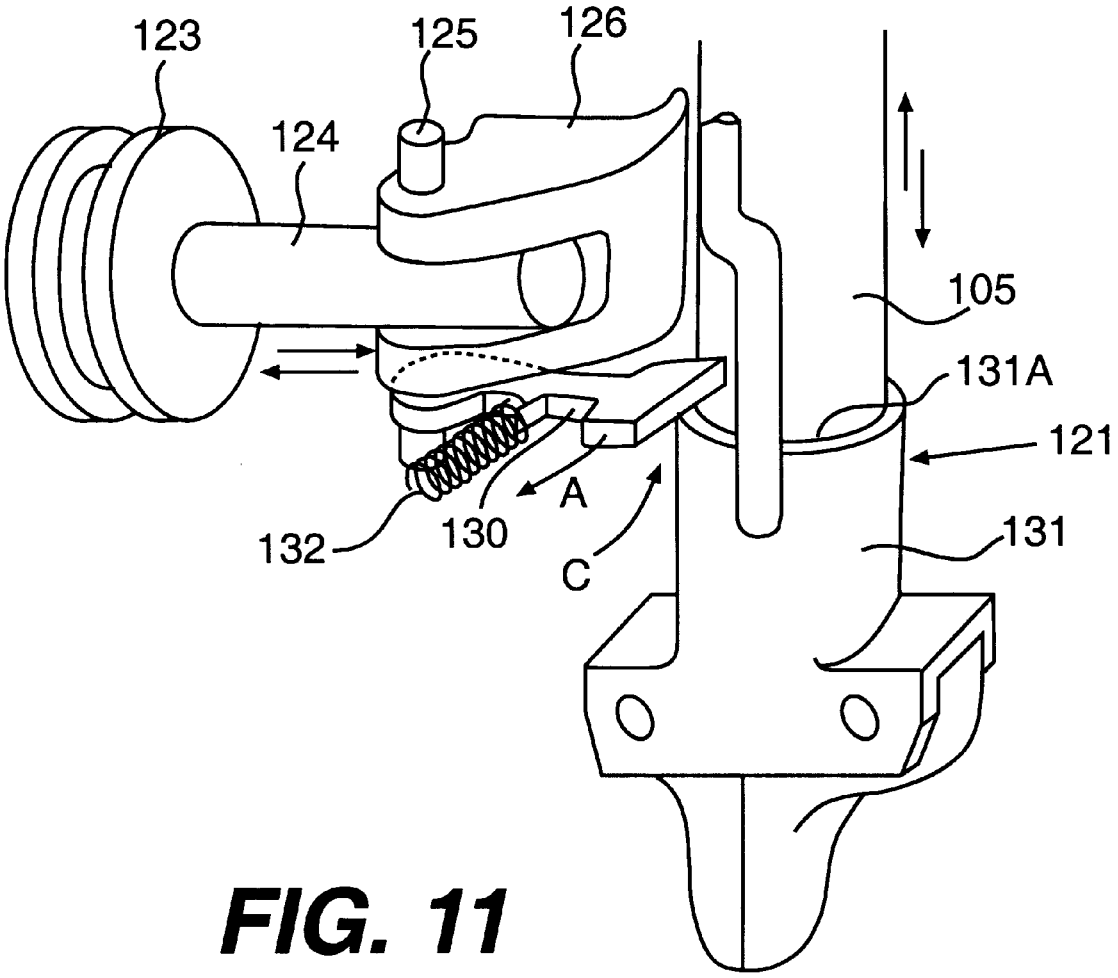
FIG. 11 is a perspective view showing essential components of the locking mechanism.

The air cylinder device 111 is shown in FIGS. 8 and 11. That is, a feed piston 123 is slidably set in a cylinder 122. A feed pawl 126 is swingably coupled to a supporting pin 125 connected to the end of a feed rod 124 which is coupled to the feed piston 123. The feed piston 123 is kept urged by a spring 127 towards a screw feed side. Compressed air is supplied through an air supply hole 128 formed in the cylinder 122, to move the feed piston backwardly a predetermined distance corresponding to one screw.

The air supply hole 128 is communicated through an air passageway (not shown) with the blow-back chamber 116. When the screw is hammered, the compressed air is supplied from the blow-back chamber 116 to the cylinder 122 to move the feed pawl 126 backwardly. After the screw has been hammered, the compressed air is discharged from the blow-back chamber 116, while the compressed air is discharged from the cylinder 122. Hence, the feed piston 123 is operated in the screw feed direction, so that a screw is fed into the nose section 105. Therefore, the feed piston 123 is normally positioned by the spring 127 at the end on the screw feed side.

In FIG. 8, reference numeral 121 designates a contact arm. The contact arm 121 is slidable along the nose section 105. More specifically, as the end of the contact arm 121 is pushed against the work 115, the contact arm 121 is pushed back towards the machine body (or relatively moved upwardly). As a result, the upper end of the contact arm 121 is moved upwardly, to make the pull-in operation of the trigger lever 112 effective (in operating the trigger valve 113). That is, it has the same safety device as an ordinary nailing machine. The lower end portion of the contact arm 121 is formed cylindrical so as to surround the nose section 105.

The contact arm 121 functions as safety means as was described above. In addition, the contact arm 121 prevents the screw from being hammered entirely into the work 115. That is, the contact arm 121 functions to stop the end of the bit 103 above the surface of the work 115; that is, the screw is hammered with the head of the screw away from the surface of the work. Hence, the contact arm 121 is so designed that it is moved (slid) in two steps. For this purpose, the contact arm 121 has a locking mechanism c so that, in the first step, the safety means is released, and the screw is hammered into the work with its head held above the work (cf. FIG. 9). More specifically, in the first step, the contact arm 121 thus moved is locked by the locking mechanism. After the screw is hammered to the predetermined depth, the locking mechanism is released, so that the contact arm 121 is allowed to perform its second movement. Thus, the screw is screwed into the material.

Figure 10:
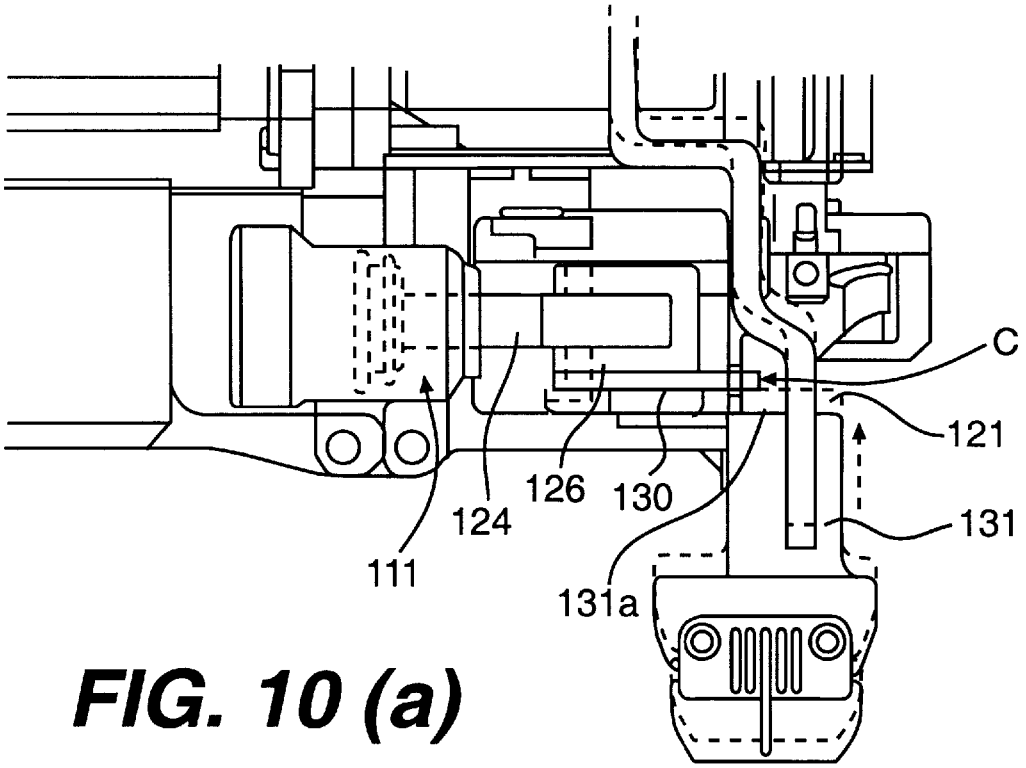
FIG. 10(*a*) and 10(*b*) are explanatory diagrams for a description of the operation of a locking mechanism.
Figure 10:
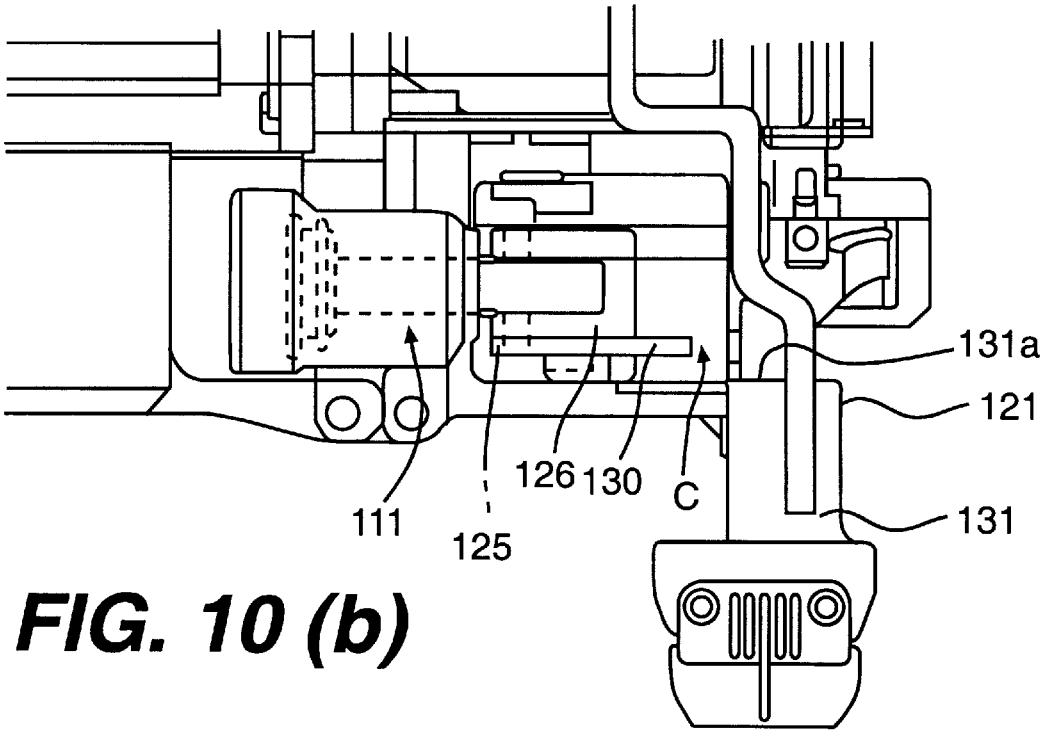

The above-described locking mechanism c, as shown in FIG. 10(*a*) and FIG. 11, comprises: a locking piece 130 which operates in association with the air cylinder device 111. The locking piece 130 is moved into or out of engagement with the cylindrical portion 131 of the contact arm 121. The locking piece 130 is swingably mounted on the supporting pin 125 of the feed rod 124 of the air cylinder device 111, and urged by a spring 132 in one direction. The feed piston 123 is normally positioned by the spring 132 at the end on the feed side. The end of the locking piece 130 is so shaped that, under this condition, it is engaged with the upper edge 131*a* of the cylindrical portion 131 when the contact arm 121 is moved upwardly, and the movement of the contact arm 121 is locked in the first step. When the feed piston 123 is moved in the feed direction, the end of the locking piece 130 is caused to strike the arm portion of the contact arm; however, in this case, the locking piece 130 is pivoted about the supporting pin 125 against the elastic force of the spring 132; that is, it moves sideward (in the direction of the arrow A in FIG. 11, thus not obstructing the movement of the feed pawl 126.

When, on the other hand, the hammering mechanism a is activated in response to the "on" signals from the trigger valve 113 and the head valve 114, the compressed air is supplied from the blow-back chamber 116 into the cylinder 122 of the screw feeding air cylinder device 111, so that the locking piece 130 together with the feed pawl 126 is moved backwardly, thus disengaging from the contact arm 121; that is, the locking mechanism c is released.

In hammering the screw 106 of the screw driving machine thus constructed, the lower end of the contact arm 121 is pushed against the work 115 as shown in FIG. 9, the contact arm 121 is slid upwardly (towards the machine body 101) to the first step position (indicated by the dotted lines in FIG. 10(*a*)) where it is locked by the locking mechanism c. This slide operation makes the trigger lever pulling operation effective. Hence, by drawing the trigger lever 112, the hammering mechanism a is operated; that is, the hammering piston 104 is driven, so that the screw is hammered to a predetermined depth with its head held above the work. In driving the hammering piston 104, the air in the blow-back chamber 116 is compressed, and the air thus compressed is supplied into the screw feeding air cylinder device 111 as shown in FIG. 10(*b*), so that the feed piston 123 is moved backwardly against the elastic force of a spring 127. Hence, the locking piece 130 is also moved backwardly, thus disengaging from the upper edge 131*a* of the cylindrical portion 131 of the contact arm 121.

In the hammering operation, part of the compressed air supplied to the hammering cylinder 102 is applied to the air motor 107 to drive the screwing mechanism b. As a result, the bit 103 is rotated; that is, it is rotated while engaging with the driving groove in the head of the screw 106, so that the latter 106 is screwed into the work 115. The locking mechanism c is released by the compressed air in the blow-back chamber 116, while the screwing mechanism b is operated by the compressed air in the hammering cylinder 102. The releasing of the locking mechanism c is achieved earlier than the screwing.

When, after the screw has been screwed into the material 115, the trigger lever 112 is released, the hammering piston 104 is returned to its initial position, while the compressed air is discharged from the blow-back chamber. Hence, the feed piston 123 of the air cylinder device 111 feeds another screw with the aid of the spring 127 as shown in FIG. 10(*a*), and the locking piece 130 of the locking mechanism c is moved to engage with the contact arm 121.

With the above-described screw driving machine, the screw 106 is hammered and screwed through the following operating steps: operating the locking mechanism c, releasing the safety means, hammering the screw with the hammering mechanism, releasing the locking mechanism c, and screwing the screw with the screwing mechanism. That is, after the screw 106 is hammered to the predetermined depth, with the locking mechanism c of the contact arm 121 released, the bit 103 is engaged with the head groove of the screw 106 and then rotated. This feature effectively prevents the bit from disengaging from the screw which is to be screwed in.

In the case where the screw driving machine is so designed that the locking of the contact arm 121 is released before the air motor 107 is rotated in response to the provision of the signal for operation of the hammering mechanism, the invention is not always limited to the above-described embodiment. For instance, the locking mechanism c may be so designed as to lock the contact arm in the first step. In addition, the above-described screw feeding air cylinder device may be replaced with an air cylinder different from it. In the above-described embodiment, the signal for releasing the locking mechanism is of the compressed air in the blow-back chamber 116; however the invention is not limited thereto or thereby. That is, the compressed air in the cylinder chamber, or in the head valve chamber, or in the trigger valve may be equally utilized; or compressed air independent of those may be employed.

What is claimed is:

1. A screw driving machine for driving a screw having a head into a workpiece, comprising:

a body;

a nose section disposed on the body positioned toward the workpiece with respect to the body, the nose section being configured to hold the screw to be driven;

a hammering mechanism disposed within the body for hammering the screw partially into the workpiece such that the head of the screw is spaced from the workpiece;

a screwing mechanism for screwing the hammered screw into the workpiece;

a contact arm slidably disposed with respect to the nose section, the contact arm being at an initial, fully-extended position relative to the nose section when the contact arm is separated from the workpiece and being capable of being pushed in toward the body when the contact arm is pushed against the workpiece; and a locking mechanism for preventing the contact arm from sliding relative to the nose section past a predetermined position when the contact arm is pushed against the workpiece such that the nose section is spaced from the workpiece thereby restricting penetration of the screw into the workpiece by the hammering mechanism such that the head of the screw is spaced from the workpiece and for releasing the contact arm after the hammering mechanism hammers the screw into the workpiece to allow the nose section to move toward the workpiece and allow the screw mechanism to screw the screw into the workpiece, wherein the locking mechanism comprises means for preventing the locking mechanism from obstructing the return of the contact arm to the initial position after the screwing mechanism screws the screw into the workpiece.

2. The screw driving machine according to claim 1, wherein the locking mechanism includes:

an engaging edge formed on the contact arm; and a stopper piece disposed in the nose section, the stopper piece being movable between a first position where the stopper piece engages the engaging edge formed on the contact arm and prevents the contact arm from sliding past the predetermined position and a second position where the stopper piece does not interfere with the sliding of the contact arm.

3. The screw driving machine according to claim 2, wherein the screwing mechanism includes an air motor, and the locking mechanism releases the contact arm before the air motor starts rotating.

4. The screw driving machine according to claim 3 further comprising an air cylinder device including:

a cylinder;

a feed piston slidably disposed within the cylinder; and a feed pawl pivotally connected to the feed piston for feeding the screw to be driven, the stopper piece of the locking mechanism being pivotally disposed on the feed pawl.

5. The screw driving machine according to claim 2, wherein the screwing mechanism includes a rack and a pinion gear engaging with the rack, the pinion being operatively associated with the stopper piece such that the pinion moves the stopper piece to the second position while the screwing mechanism screws the screw into the workpiece.

6. A locking mechanism for a screw driving machine, the screw driving machine having a slidable contact arm for positioning the screw driving machine relative to a workpiece and an air cylinder device for feeding a screw to be driven, the screw driving machine being capable of hammering the screw partially into the workpiece by compressed air, the locking mechanism comprising:

an engaging edge formed on the contact arm; and a stopper piece operatively associated with the air cylinder device, the stopper piece being movable between a first position where the stopper piece engages with the engaging edge formed on the contact arm and prevents the contact arm from sliding past a predetermined position and a second position where the stopper piece does not interfere with the sliding of the contact arm, wherein the air cylinder device normally positions the stopper piece at the first position and moves the stopper piece to the second position at the same time that the compressed air for hammering the screw is discharged.

* * * * *